US007370642B2

(12) United States Patent
Amano et al.

(10) Patent No.: US 7,370,642 B2
(45) Date of Patent: May 13, 2008

(54) FUEL VAPOR TREATMENT APPARATUS

(75) Inventors: Noriyasu Amano, Gamagori (JP); Naoya Kato, Ama-gun (JP); Masao Kano, Gamagori (JP); Shinsuke Takakura, Kariya (JP)

(73) Assignees: Denso Corporation, Kariya, Aichi-pref. (JP); Nippon Soken, Inc., Nishio, Aichi-pref. (JP)

( * ) Notice: Subject to any disclaimer, the term of this patent is extended or adjusted under 35 U.S.C. 154(b) by 26 days.

(21) Appl. No.: 11/583,089

(22) Filed: Oct. 19, 2006

(65) Prior Publication Data

US 2007/0089721 A1 Apr. 26, 2007

(30) Foreign Application Priority Data

Oct. 21, 2005 (JP) ..... 2005-307219

(51) Int. Cl.
*F02M 33/02* (2006.01)
*F02D 41/00* (2006.01)

(52) U.S. Cl. ..... 123/520; 123/674; 123/698

(58) Field of Classification Search ..... 123/516, 123/518, 519, 520, 674, 698
See application file for complete search history.

(56) References Cited

U.S. PATENT DOCUMENTS 5,178,117 A * 1/1993 Fujimoto et al. ..... 123/520
5,216,995 A * 6/1993 Hosoda et al. ..... 123/520
5,390,645 A * 2/1995 Cook et al. ..... 123/520
5,909,726 A * 6/1999 Kobayashi et al. ..... 123/520
6,247,456 B1 * 6/2001 Everingham et al. ..... 123/520
6,390,083 B2 * 5/2002 Oki et al. ..... 123/698
6,971,375 B2 12/2005 Amano et al.
7,219,660 B2 * 5/2007 Amano et al. ..... 123/520
7,246,608 B2 * 7/2007 Kano et al. ..... 123/519
2004/0129259 A1 * 7/2004 Mitsutani ..... 123/698
2006/0031000 A1 2/2006 Amano et al.
2006/0144373 A1 7/2006 Kano et al.

FOREIGN PATENT DOCUMENTS

JP 5-18326 1/1993
JP 6-101534 4/1994
JP 10-266908 10/1998

OTHER PUBLICATIONS

U.S. Appl. No. 11/398,755, filed Apr. 2006, Kano et al.

* cited by examiner

*Primary Examiner*—Thomas Moulis
(74) *Attorney, Agent, or Firm*—Nixon & Vanderhye P.C.

(57) ABSTRACT

A CPU measures an actual air-fuel ratio based on the signals detected by the air-fuel ratio sensor. When the difference between the actual air-fuel ratio and a target air-fuel ratio is larger than a predetermined value, the computer determines that a fuel vapor amount purged into the intake passage deviates from a target value due to an incorrectness of a reference flow quantity of the purge valve. The computer calculates an actual reference flow quantity based on a measured actual air-fuel ratio, and rewrites the reference flow quantity corresponding to a current intake pressure into the calculated the reference flow quantity. Thereby, the difference between the actual air-fuel ratio and the target air-fuel ratio can be reduced.

22 Claims, 11 Drawing Sheets

| P0 (kPa) | Q100 (L/min) |
|---|---|
| 20 | 60 |
| 30 | 80 |
| •••• | •••• |
| •••• | •••• |
| •••• | •••• |
| •••• | •••• |
| •••• | •••• |
| 100 | 0 |

FUEL VAPOR TREATMENT APPARATUS

CROSS-REFERENCE TO RELATED APPLICATION

This application is based on Japanese Patent Applications No. 2005-307219 filed on Oct. 21, 2005, the disclosure of which is incorporated herein by reference.

FIELD OF THE INVENTION

The present invention relates to a fuel vapor treatment apparatus that treats fuel vapor produced in a fuel tank of an internal combustion engine. A canister of the fuel vapor treatment apparatus adsorbs the fuel vapor therein, and purges the fuel vapor into an intake passage of an internal combustion engine.

BACKGROUND OF THE INVENTION

A fuel vapor treatment apparatus includes a canister that temporarily adsorbs fuel vapor evaporated in a fuel tank. The fuel vapor desorbed from the canister is introduced and purged, through a purge passage, into an intake passage of the internal combustion engine by intake pressure. A purge control valve disposed in the purge passage controls amount of air including the fuel vapor, which is purged into the intake passage.

The purged fuel vapor is combusted in the engine with the fuel supplied from a fuel injector. Hence, it is necessary to accurately measure the amount of fuel vapor in order to keep an air-fuel ratio within a predetermined range.

JP-5-18326A and JP-6-101534A show a system in which concentration of the fuel vapor is detected in order to control the opening degree of the purge valve and the fuel injection amount in such a manner as to obtain a target air-fuel ratio. However, even if the opening degree of the purge valve is controlled based on a preset flowrate characteristic in order to obtain the target air-fuel ratio, the amount of fuel vapor purged from the canister may be different from the target value due to a dispersion of the flowrate characteristic of each purge valve or a varying of the flowrate characteristic with age. As the result, an actual air-fuel ratio of the engine may deviate from the target air-fuel ratio.

Besides, when the measured concentration of the fuel vapor deviates from the actual concentration of the fuel vapor, the actual air-fuel ratio may deviate from the target air-fuel ratio.

SUMMARY OF THE INVENTION

The present invention is made in view of the above matters, and it is an object of the present invention to provide a fuel vapor treatment apparatus that can decrease a difference between the actual air-fuel ratio and the target air-fuel ratio when purging the fuel vapor.

According to a fuel vapor treatment apparatus of the present invention, an opening degree of the purge valve and/or the fuel injection amount is controlled based on a flow characteristic of the purge valve and the fuel vapor concentration so that the air-fuel ratio becomes close to a target air-fuel ratio. The computer compares the actual air-fuel ratio with the target air-fuel ratio. In a case that a difference between the actual air-fuel ratio and the target air-fuel ratio exceeds a predetermined value, the flow characteristic of the purge valve is corrected in order to reduce the difference between the actual air-fuel ratio and the target air-fuel ratio. Thereby, even if dispersion in the flow characteristic of the purge valve exists, or even if the flow characteristic varies with age, the difference between the actual air-fuel ratio and the target air-fuel ratio can be reduced.

BRIEF DESCRIPTION OF THE DRAWINGS

Other objects, feature and advantages of the present invention will become more apparent from the following detailed description made with reference to the accompanying drawings, in which like parts are designated by like reference numerals and in which.

DETAILED DESCRIPTION OF THE PREFERRED EMBODIMENTS

First Embodiment

Figure 1:
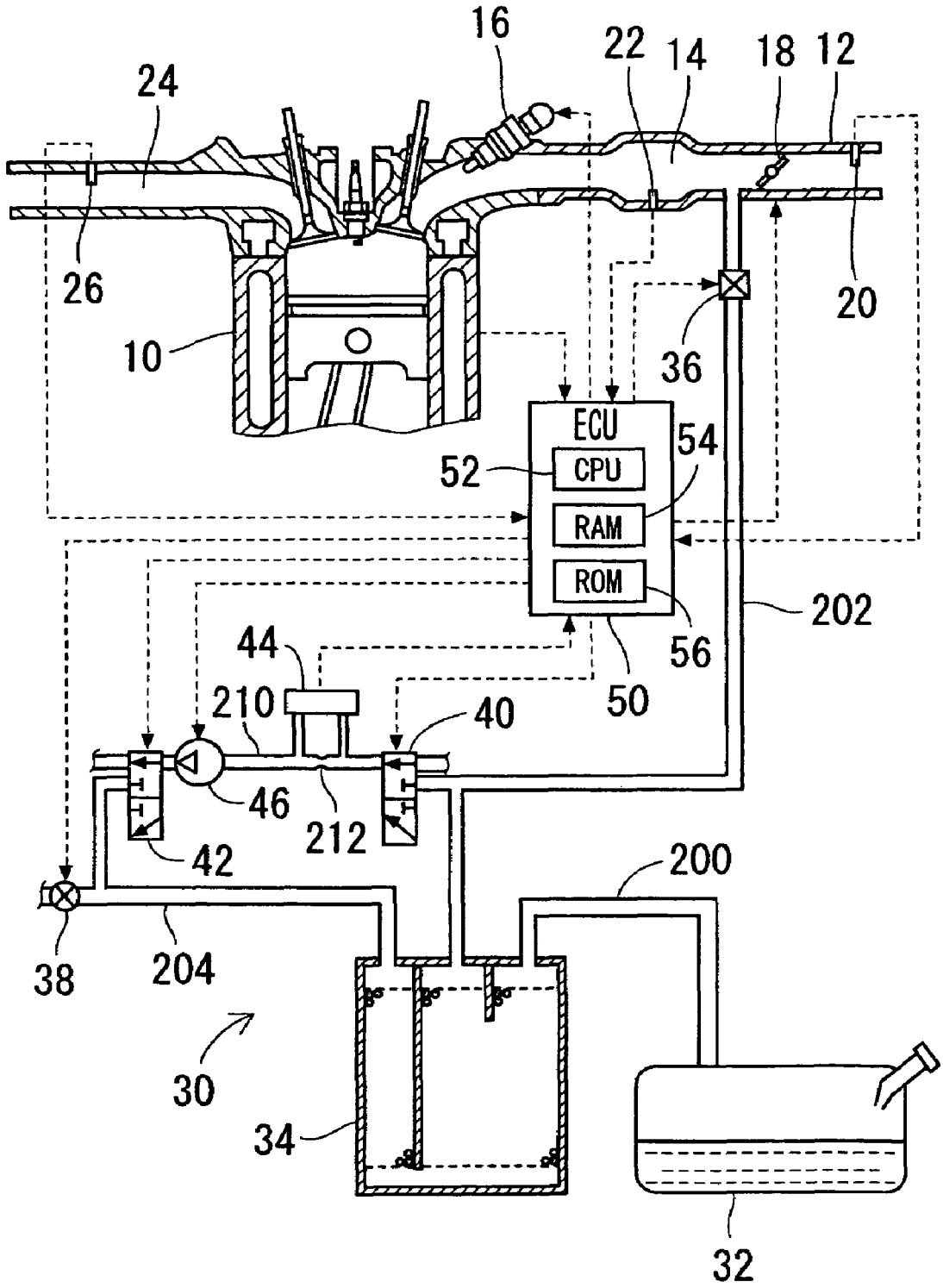
FIG. 1 is a schematic view of a fuel vapor treatment apparatus according to a first embodiment.

FIG. 1 is a schematic view of a fuel vapor treatment apparatus 30, which is applied to an internal combustion engine 10.

The engine 10 is a gasoline engine in which gasoline is combusted supplied from a fuel tank 32. The engine 10 is provided with a fuel injection valve 16, a throttle valve 18, an airflow sensor 20, and an intake pressure sensor 22 in an intake passage 14 of the intake pipe 12. The engine 10 is provided with an air-fuel ratio sensor 26 in an exhaust passage 24.

The fuel vapor treatment apparatus 30 is provided with a canister 34, a purge valve 36, an atmosphere valve 38, a first switching valve 40, a second switching valve 42, a differential pressure sensor 44, a pump 46, and an electronic control unit (ECU) 50. The fuel vapor treatment apparatus controls the concentration of the fuel vapor that is purged into the intake passage 14 and the fuel injection amount that is injected through the fuel injection valve 16 in such a manner that the air-fuel ratio becomes the target air-fuel ratio.

A passage 200 connects the fuel tank 32 with the canister 34. The fuel vapor generated in the fuel tank 32 flows in the passage 200 and is adsorbed by adsorbent, such as activated carbon, in the canister 34. When the purge valve 36 is opened, the fuel vapor adsorbed in the canister 34 flows in the purge passage 202 and is purged into the intake passage 14 downstream of the throttle valve 18 by intake pressure in the intake passage 14.

The atmosphere valve 38 is a normally opened two-way valve. When the atmosphere valve 38 is opened, a passage 204 connected to the canister 34 communicates with the atmosphere. When the purge valve 36 and the atmosphere valve 38 are opened, the fuel vapor is purged into the intake passage 14 through the purge passage 202.

The first switching valve 40 is a three-way valve, which changes between a first position in which an orifice 212 communicates with the atmosphere and a second position in which the orifice 212 communicates with the purge passage 202. The first switching valve 40 is in the first position when it is not energized as shown in FIG. 1. The second switching valve 42 is a three-way valve, which changes between a first position in which the pump 46 communicates with the atmosphere and a second position in which the pump 46 communicates with a passage 204 connected to the canister 34. The second switching valve 42 is in the first position when it is not energized as shown in FIG. 1.

A passage 210 connects the first switching valve 40 and the pump 46, and is provided with the orifice 212. A differential pressure sensor 44 is connected to the passage 210 at both sides of the orifice 212 in order to detect deferential pressure between upstream and downstream of the orifice 212. When the pump 46 is driven and the first switching valve 40 is in the first position, the differential pressure sensor 44 detects differential pressure $\Delta P_{AIR}$ that is caused by air passing through the orifice 212. When the pump 46 is driven and the first switching valve 40 is in the second position, the differential pressure sensor 44 detects differential pressure $\Delta P_{GAS}$ that is caused by mixture of the fuel vapor and air passing through the orifice 212.

The ECU 50 is comprised of a CPU 52, a RAM 54, and a ROM 56. The CPU 52 controls the fuel injection valve 16 and the throttle valve 18 based on signals detected by the airflow sensor 20, the intake pressure sensor 22, the air-fuel ratio sensor 26, and detected signals indicative of ignition, engine speed, engine coolant temperature, accelerator position. Furthermore, the CPU 52 controls operations of the purge valve 36, the atmosphere valve 38, the first switching valve 40, the second switching valve 42 and the pump 46 in order to adjust the amount of fuel vapor purged to the intake passage 14. The RAM 54 temporarily stores data and programs, which are executed by the CPU 52. The ROM 56 is a non-volatile memory, such as an EEPROM, which stores control programs that are executed by the CPU 52.

Figure 10:
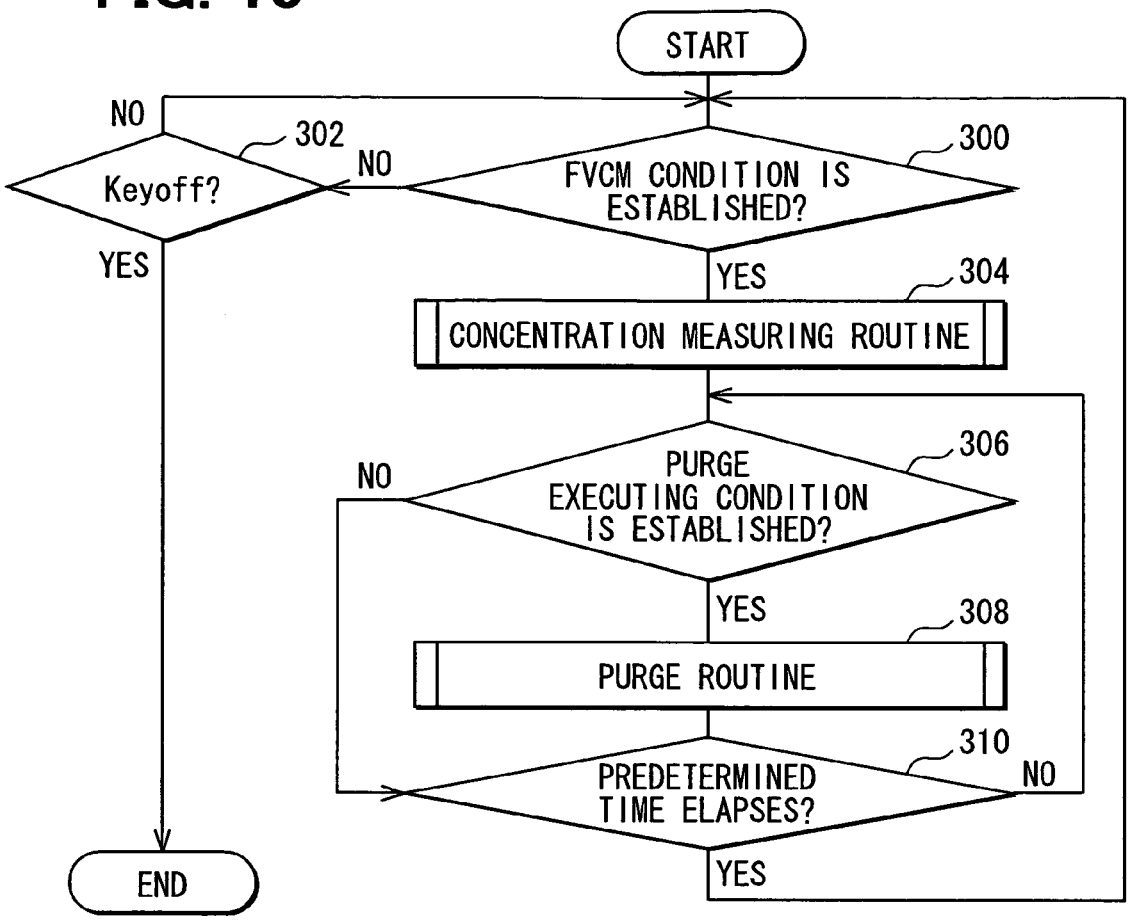
FIG. 10 is a flowchart showing a main routine of a fuel vapor treatment.

FIG. 10 shows a main routine in which a concentration of fuel vapor is measured and an amount of fuel vapor that is purged is calculated based on the concentration of fuel vapor. The concentration of the fuel vapor is referred to as the fuel vapor concentration hereinafter. This routine is executed after an ignition key is turned ON. In an initial condition (period T1 in FIG. 4), the purge valve 36, the atmosphere valve 38, the first switching valve 40, the second switching valve 42 and the pump 46 are deenergized. In this condition, the purge valve 36 is closed and the atmosphere valve 38 is opened. The first switching valve 40 and the second switching valve 42 are in the first positions as shown in FIG. 1.

In step 300, the CPU 52 determines whether a measuring condition of the fuel vapor concentration is established. This measuring condition of the fuel vapor concentration is referred to as a FVCM condition, hereinafter. For example, when the engine speed exceeds a predetermined value or the engine coolant temperature exceeds a predetermined value, the CPU 52 determines that the FVCM condition is established. When the purging of the fuel vapor is suspended during a deceleration of the engine, the CPU 52 determines that the FVCM condition is established. In a case that the fuel vapor treatment apparatus 30 is applied to a hybrid vehicle, the CPU 52 determines that the FVCM condition is established when the vehicle is driven only by a motor.

In step 306, the CPU 52 determines whether a purge executing condition is established. For example, the purge executing condition is established when the engine coolant temperature exceeds the engine coolant temperature which is obtained at the time when the FVCM condition is established. Thus, the FVCM condition is established earlier than the purge executing condition.

When the FVCM condition is not established, the CPU 52 determines whether the ignition key is turned OFF (step 302). When the ignition key is turned OFF, the routine ends. When the ignition key is ON, the procedure goes back to step 300.

When the FVCM condition is established in step 300, the procedure proceeds to step 304 in which a concentration measuring routine is executed in order to measure the concentration of the fuel vapor, which is purged into the intake passage 14 from the canister 34.

After the concentration of the fuel vapor is measured in step 304, the CPU 52 determines whether the purge executing condition is established in step 306. When the answer is Yes in step 306, the procedure proceeds to step 308 in which the CPU 52 executes a purge routine. In the purge routine, the fuel vapor is purged onto the intake passage 14 from the canister 34 based on the measured fuel vapor concentration. After the purge routine is executed in step 308, the CPU 52 determines whether a predetermined time period elapses after the execution of the concentration measuring routine in step 310. When the answer is Yes in step 310, it may be that the amount of fuel vapor adsorbed in the canister varies and the fuel vapor concentration varies. The procedure goes back to step 300, and the routine in step 304 is executed again. The predetermined time period in step 310 is set according to variation of the fuel vapor concentration with time and a measuring accuracy of fuel vapor concentration. When the answer is NO in step 310, the procedure goes back to step 306. When the answer is NO in step 306, the procedure proceeds to step 310.

The concentration measuring routine, which is executed in step 304, will be described in detail hereinafter.

Figure 2:
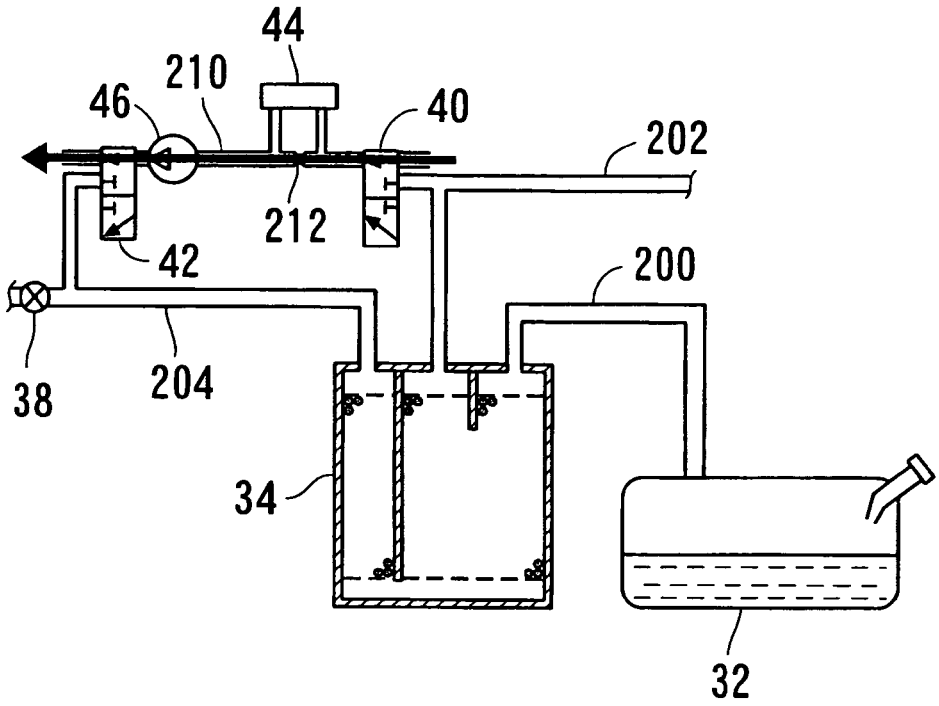
FIG. 2 is a schematic view for explaining flow passages at a time of measuring air pressure.
Figure 4:
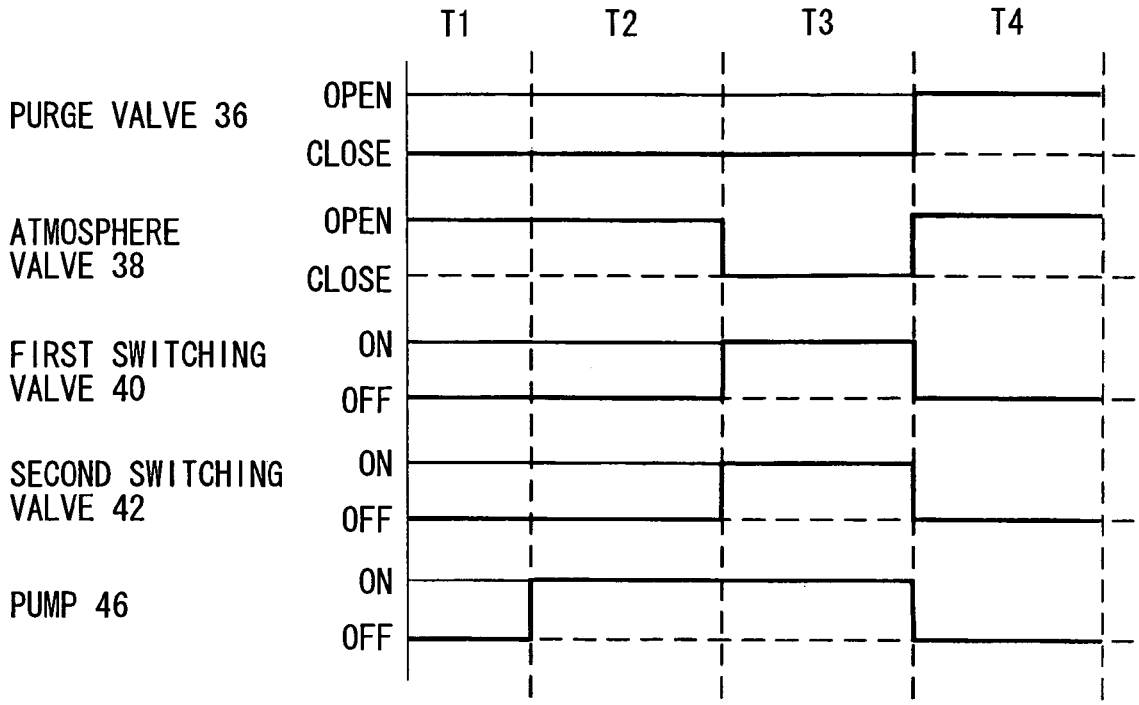
FIG. 4 is a time chart showing operations of valves and the pump.

In step 320, the CPU 52 drives the pump 46 when the first switching valve 40 and the second switching valve 42 are in the first positions as shown in FIG. 2 (period T2 in FIG. 4). Since only air passes through the orifice 212, the differential pressure sensor 44 detects the differential pressure $\Delta P_{AIR}$ in step 322.

Figure 3:
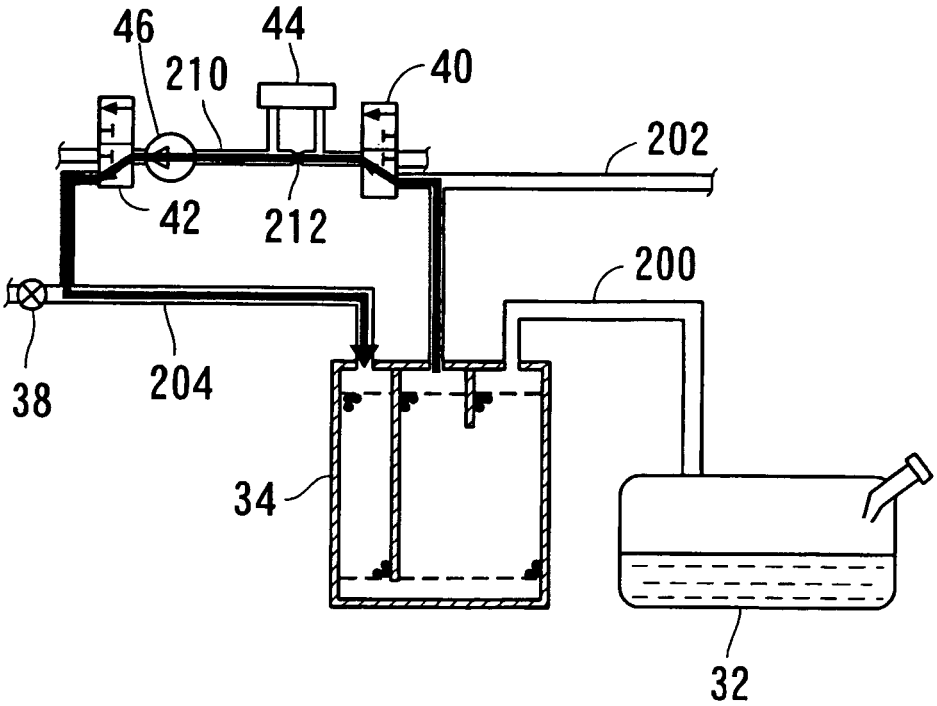
FIG. 3 is a schematic view for explaining flow passages at time of measuring fuel mixture pressure.

Next, the CPU 52 opens the atmosphere valve 38 in step 324 and energizes the first switching valve 40 and the second switching valve 42 in step 326 as shown in FIG. 3 (period T3 in FIG. 4). The purge valve 36 is maintained closed. Thereby, a ring passage is formed, which is comprised of the canister 34, the first switching valve 40, the orifice 212, the pump 46, the second switching valve 42, and the passage 204. The mixture of the fuel vapor and the air circulates in this ring passage. The differential pressure sensor 44 detects the differential pressure $\Delta P_{GAS}$ in step 328.

Figure 6:
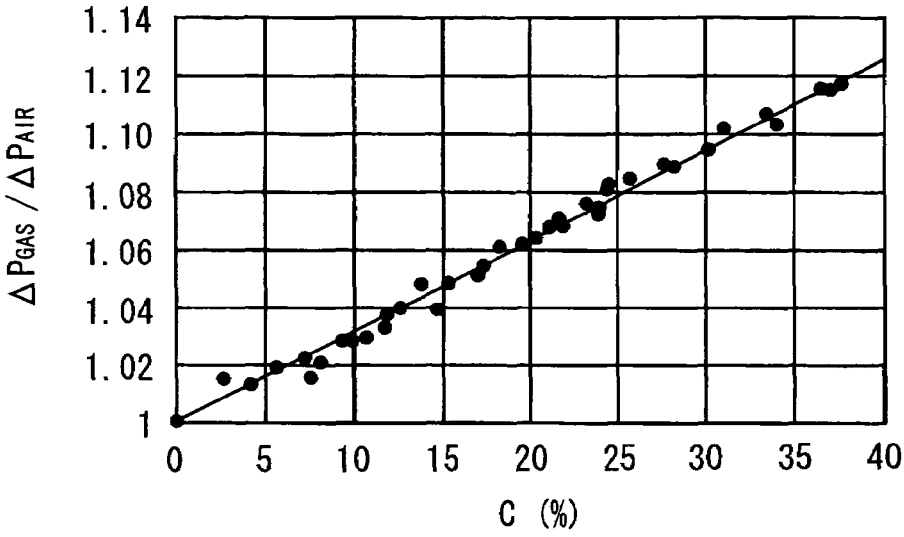
FIG. 6 is a characteristic chart showing a relationship between the fuel vapor concentration and the differential pressure.

In step 330, the CPU 52 calculates a differential pressure ratio Pp according to an equation (1) in step 330. Then, the CPU 52 calculates the fuel vapor concentration C based on the ratio Pp according to an equation (2) in step 332, and stores the fuel vapor concentration C in the RAM 54 in step 334.

$$Pp=\Delta P_{GAS}/\Delta P_{AIR} \quad (1)$$

$$C=k1\times(Pp-1) \quad (2)$$

wherein k1 is a coefficient stored in the ROM 56, which represents an inclination of a line in FIG. 6.

Figure 5:
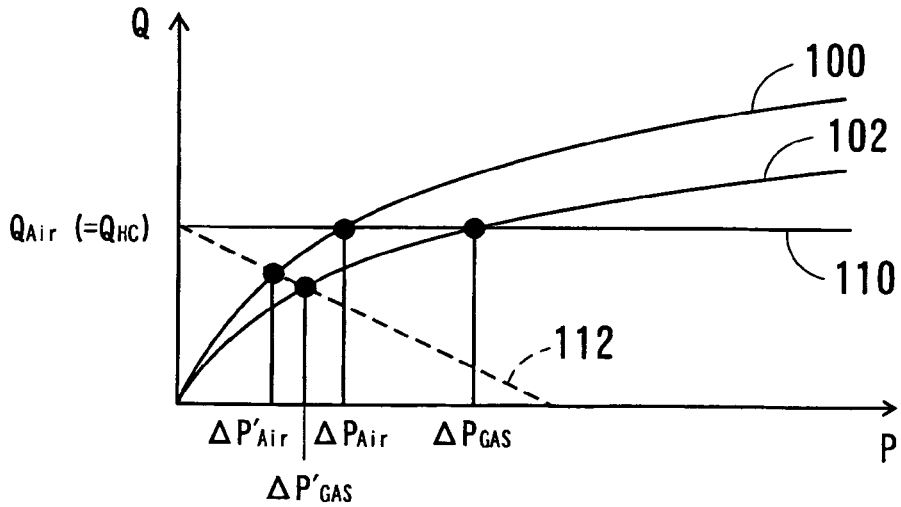
FIG. 5 is a characteristic chart showing a pump characteristic and an orifice characteristic with respect to differential pressure and flow quantity.

In FIG. 5, a curved line 100 represents a relationship between the differential pressure $\Delta P_{AIR}$ and quantity Q of air passing through the orifice 212, and a curved line 102 represents a relationship between the differential pressure $\Delta P_{GAS}$ and quantity Q of the mixture passing through the orifice 212. A solid line 110 and a dashed line 112 represent a pump characteristic that is a relationship between the pressure and the discharged quantity of the pump 46. The solid line 110 shows the pump characteristic in a case that the pump 46 is driven at a constant speed. The dashed line 112 shows the pump characteristic in a case that the pump is normally driven. Since a pressure loss other than at the orifice 212 is neglectable, abscissa axis P in FIG. 5 substantially represents the differential pressure ΔP at the orifice 212.

When the pump 46 is normally driven, the differential pressure increases with a decrement of the quantity as shown by dashed line 112. As the result, the detected air pressure and the detected mixture pressure are $\Delta P'_{AIR}$ and $\Delta P'_{GAS}$ as shown in FIG. 5, which means a gain is relatively small. According to the present invention, the pump 46 is driven at a constant speed, so that the discharged quantity is substantially constant without respect to the differential pressure as shown by dashed line 112. As the result, the detected air pressure and the detected mixture pressure are $\Delta P_{AIR}$ and $\Delta P_{GAS}$ as shown in FIG. 5, which means the gain is relatively large.

When the rotation speed of the pump 46 is decreased, the differential pressure ΔP is also decreased, so that the measuring accuracy of the fuel vapor concentration deteriorates. On the other hand, when the rotation speed pump is excessively increased, the differential pressure ΔP is increased, so that driving pressure of the first switching valve 40 and the second switching valve 42 increases. As the result, it may cause upsizing of an electromagnetic driving portion of the switching valves 40, 42. Considering such a situation, it is preferable to drive the pump 46 at an appropriate constant speed.

Besides, according to the energy conservation law, when the flowing speed of gas flowing in the passage 210 is constant, that is, when the flowing quantity of gas is constant, the fuel vapor concentration C increases as the differential pressure $\Delta P_{GAS}$ at the orifice 212 increases. The differential pressure ratio Pp increases as the concentration C increases. As shown in FIG. 6, the fuel vapor concentration C and the differential pressure ratio Pp are substantially in direct proportion.

A characteristic of the orifice 212 that represents a relationship between the differential pressure P and the quantity Q at the orifice 212 is expressed by a following equation (3).

$$Q=k2(\Delta P/\rho)^{1/2} \quad (3)$$

wherein ρ is density of fluid passing through the orifice 212.

In the equation (3), "k2" is a coefficient that is expressed by a following equation (4)

$$k2=(\alpha\times\pi\times d^2/4)\times 2^{1/2} \quad (4)$$

wherein "α" is a flow coefficient of the orifice 212, "d" is a diameter of the orifice 212.

In a case where density of air passing through the orifice 212 is expressed by PAIR and density of mixture passing through the orifice 212 is expressed by $\rho_{GAS}$, flow quantity $Q_{AIR}$ of air and flow quantity $Q_{GAS}$ of mixture passing through the orifice 212 are expressed by the following equations (5) and (6).

$$Q_{AIR}=k2(\Delta P_{AIR}/\rho_{AIR})^{1/2} \quad (5)$$

$$Q_{GAS}=k2(\Delta P_{GAS}/\rho_{GAS})^{1/2} \quad (6)$$

Since, the pump 46 is driven at a constant speed, $Q_{AIR}$ is equal to $Q_{GAS}$. Thus, following equation (7) is obtained.

$$\rho_{GAS}/\rho_{AIR}=\Delta P_{GAS}/\Delta P_{AIR}=Pp \quad (7)$$

Since the density of the fuel vapor depends on the concentration thereof, the fuel vapor concentration C can be obtained from the equation (2) with parameter of differential pressure ratio ($\Delta P_{GAS}/\Delta P_{AIR}$).

Next, in step 336, the CPU 52 deenergizes the first switching valve 40 and the second switching valve 42, so that both switching valves 40 and 42 are positioned in the first position as shown in FIG. 2. In step 338, the pump 46 is stopped. In this situation, when the purge executing condition is established and the purge valve 36 is opened in a period T4 of FIG. 4, the fuel vapor adsorbed by the canister is purged into the intake passage 14.

Figure 13:
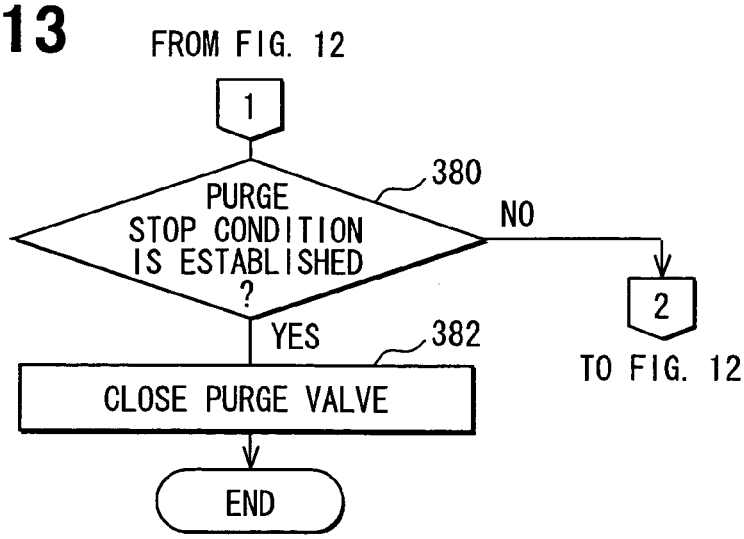
FIG. 12 and FIG. 13 are flowcharts showing a purge routine according to the first embodiment.
Figure 12:
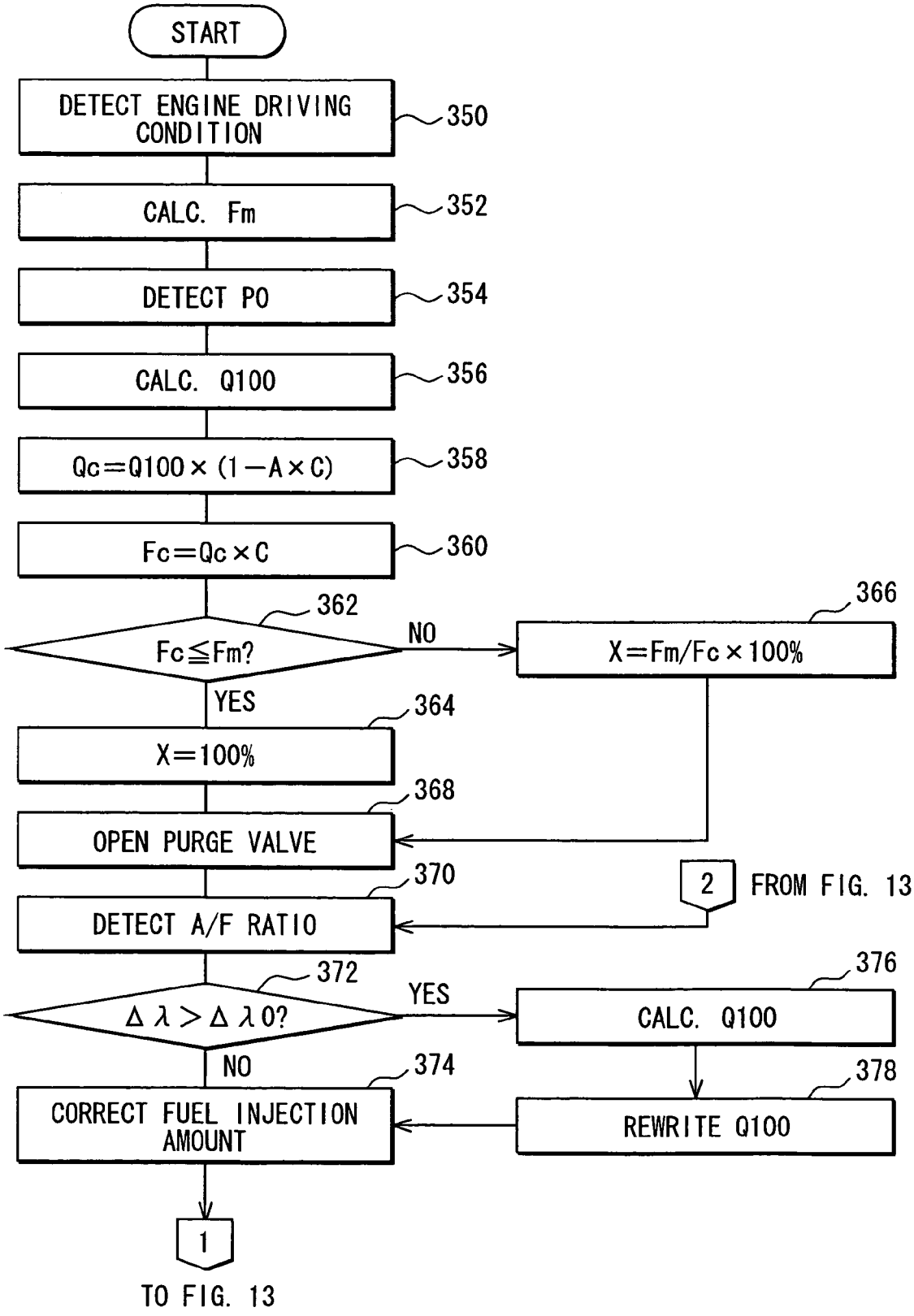

In the purge routine shown in FIGS. 12 and 13, the CPU 52 detects an engine driving condition, such as engine speed, intake air quantity and intake air pressure, in step 350.

In step 352, the CPU 352 calculates a permissible amount Fm of the fuel vapor that can be purged into the intake passage 14. The permissible amount Fm is calculated based on the required fuel injection amount and a lower limit value of the fuel injection amount that is controllable by the fuel injection valve 16. As the fuel injection amount increases, a rate of the fuel vapor amount relative to the fuel injection amount decreases and the permissible amount Fm increases.

Figures 8, 9:
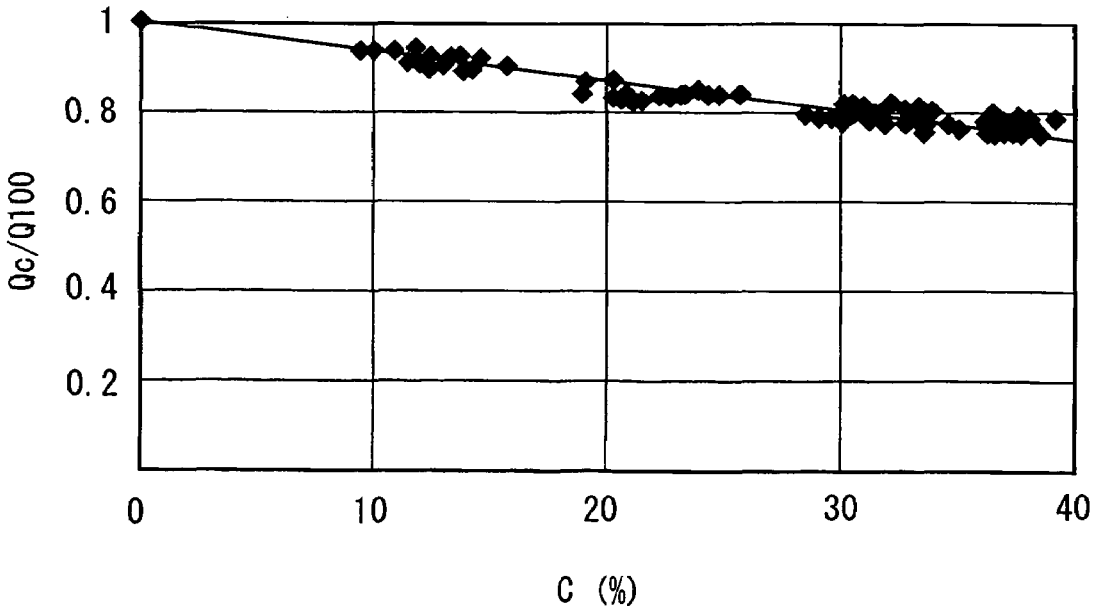
FIG. 8 is a map showing a correspondence between the intake pressure and the reference quantity.
FIG. 9 is a characteristic chart showing a relationship between the fuel vapor concentration and the ratio of Qc/Q100.

In step 354, the CPU 52 detects a present intake pressure P0 and calculates the reference flow quantity Q100 in step 356. The reference flow quantity Q100 represents quantity of air flowing through the purge passage 202 under the present intake pressure in a case that only air flows in the purge passage 202 and the purge valve 36 is fully opened. FIG. 8 shows a relationship between the intake pressure P0 and the reference flow quantity Q100 stored in the ROM 56 as a map.

The CPU 52 calculates an estimated flow quantity Qc based on the following equation (8) in step 358.

$$Qc=Q100\times(1-A\times C) \quad (8)$$

The estimated flow quantity Qc represents quantity of mixture of air and fuel vapor having a fuel vapor concentration C in a case that the purge valve 36 is fully opened. As the fuel vapor concentration C increases, the density of the fuel vapor increases. According to the energy conservation law, even if the intake pressure P0 is constant, as the fuel vapor concentration C increases, the flow quantity decreases. FIG. 9 shows a relationship between the fuel vapor concentration C and a value of Qc/Q100. "A" in the equation (8) represents an inclination of a line shown in FIG. 9, and is stored in the ROM 56.

In step 360, the CPU 52 calculates an amount Fc of fuel vapor flowing in the purge passage 202 in a case that the purge valve 36 is fully opened according to a following equation (9).

$$Fc=Qc\times C \tag{9}$$

In step 362, the CPU 52 determines whether Fc≦Fm. When the answer is Yes, the procedure proceeds to step 364 in which the opening degree X (%) of the purge valve 36 is set to 100%. If the purge valve 36 is fully opened in a case Fc exceed Fm, the excessive fuel vapor is purged into the intake passage 14. Thus, the CPU 52 adjusts the opening degree X(%) of the purge valve 36 according to a following equation (10) in step 366.

$$X=(Fm/Fc)\times 100 \tag{10}$$

In step 368, the CPU 52 opens the purge valve 36 at the opening degree established in step 364 or step 366. The amount of fuel vapor that is purged from the canister 34 is determined based on the opening degree of the purge valve 36. The fuel injection amount is controlled to obtain the target air-fuel ratio λ0 based on the amount of purged fuel vapor. The CPU 52 determines the target air-fuel ratio λ0 according to the driving condition of the engine.

After the purge valve 36 is opened and the fuel vapor is stared to be purged, the CPU 52 measures an actual air-fuel ratio λ1 based on the signals detected by the air-fuel ratio sensor 26. In step 372, the CPU 372 determines whether Δλ(=|λ1−λ0|) is larger than a predetermined value Δλ0. If the fuel injection amount is controlled so as to obtain the target air-fuel ratio before purging, the fuel injection amount must be controlled to obtain the target air-fuel ratio during purging. When the target amount of fuel vapor is purged through the purge valve 36 of which opening degree is established according to the equation (10), it must be that Δλ≦Δλ0.

When the answer is No in step 372, the CPU 52 determines that the purged fuel vapor amount and the fuel injection amount are correctly controlled. Then, the procedure proceeds to step 374 in which the fuel injection amount is corrected according to Δλ.

When the answer is Yes in step 372, the CPU 52 determines that the purged fuel vapor amount is not correct because Fc is not correct. The amount Fc is calculated according to the equations (8) and (9), and the reference Q100 is obtained based on the map shown in FIG. 8. However, because of production errors or aging of the purge valve 36 and the purge passage 202, the actual flow characteristic may deviate from the flow characteristic shown in FIG. 8. When the answer is Yes in step 372, the CPU 52 determines that the value of Q100 is not correct. The procedure proceeds to step 376 in which the actual value Q100 is calculated based on the actual air-fuel ratio λ1 according to following equations (11)-(14).

In a case that intake air quantity detected by air flow sensor 20 is represented by Ai, fuel injection quantity is represented by Fi, air quantity introduced into the intake passage 14 from the purge passage 202 is represented by Ap, and the fuel vapor quantity flowing into the intake passage 14 from the purge passage 202 is represented by Fp, the actual air-fuel ratio λ1 is expressed by a following equation (11). In the equation (11), the actual air fuel ratio λ1 is expressed merely by λ.

$$\lambda=(Ai+Ap)/(Fi+Fp) \tag{11}$$

The quantity Ap and the quantity Fp are expressed by following equations (12) and (13).

$$Ap=Qc\times(1-C)\times X\times\rho_{AIR} \tag{12}$$

$$FP=Qc\times C\times X\times\rho_{HC} \tag{13}$$

Therefore, Q100 is obtained according to a following equation (14).

$$Q100=(Ai-\lambda\times Fi)/\{(1-A\times C)\times(\lambda\times C\times X\times\rho_{HC}+(C-1)\times X\times\rho_{AIR})\} \tag{14}$$

In step 378, the CPU 52 rewrites the reference quantity Q100 corresponding to the present intake pressure P0 into the value Q100 calculated according to the equation (14). In step 374, the fuel injection amount is corrected based on the value of Δλ.

In step 380, the CPU 52 determines whether a purge stop condition is established. When the purge stop condition is established, the CPU 52 closes the purge valve 36 in step 382 to terminate the purge routine. When the purge stop condition is not established, the procedure proceeds to step 370.

As described above, according to the first embodiment, the flow characteristic of the purge valve 36 is corrected when the predetermined flow characteristic deviates from the actual flow characteristic and the difference between the actual air-fuel ratio and the target air-fuel ratio becomes larger than a predetermined value. Thereby, the actual air-fuel ratio becomes close to the target air-fuel ratio so that the difference therebetween becomes small.

Second Embodiment

Figure 11:
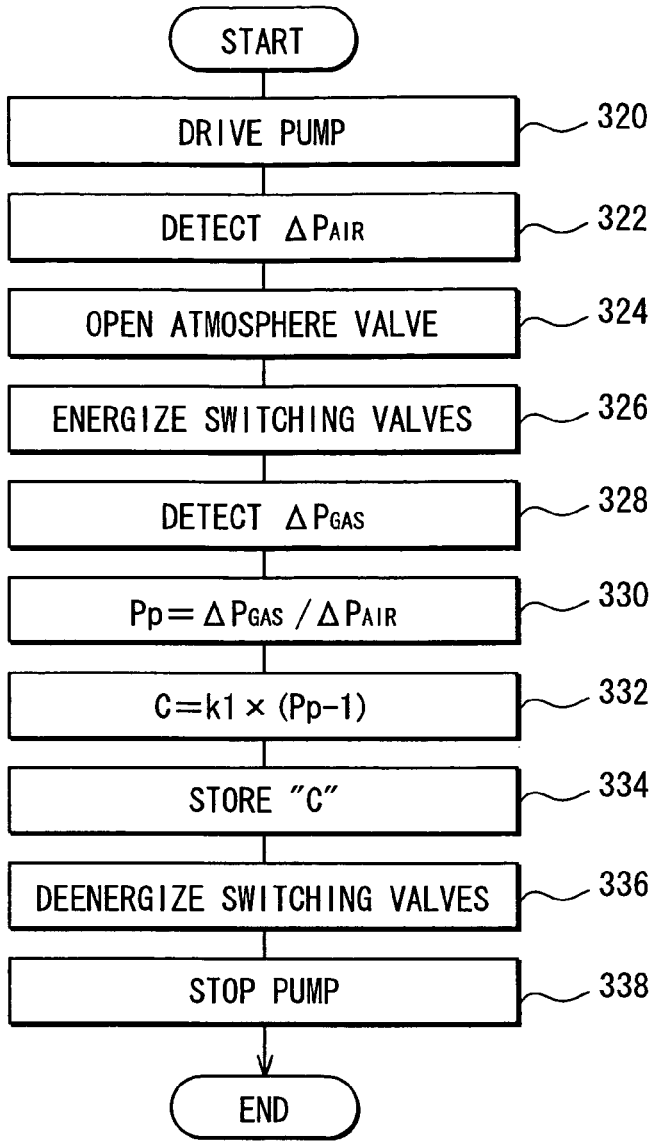
FIG. 11 is a flowchart showing a concentration measuring routine.

A structure of the fuel vapor treatment apparatus 30, the main routine (refer to FIG. 10), and the concentration measuring routine (refer to FIG. 11) are substantially the same as the first embodiment.

Figure 15:
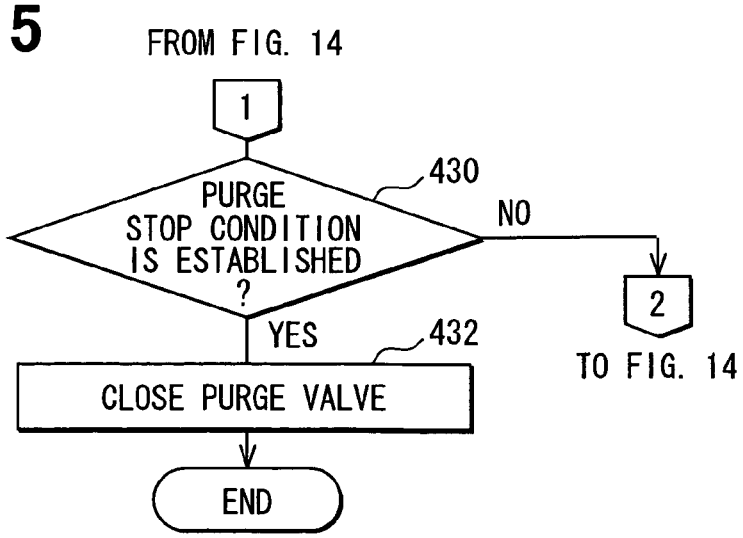
FIG. 14 and FIG. 15 are flowcharts showing a purge routine according to a second embodiment.
Figure 14:
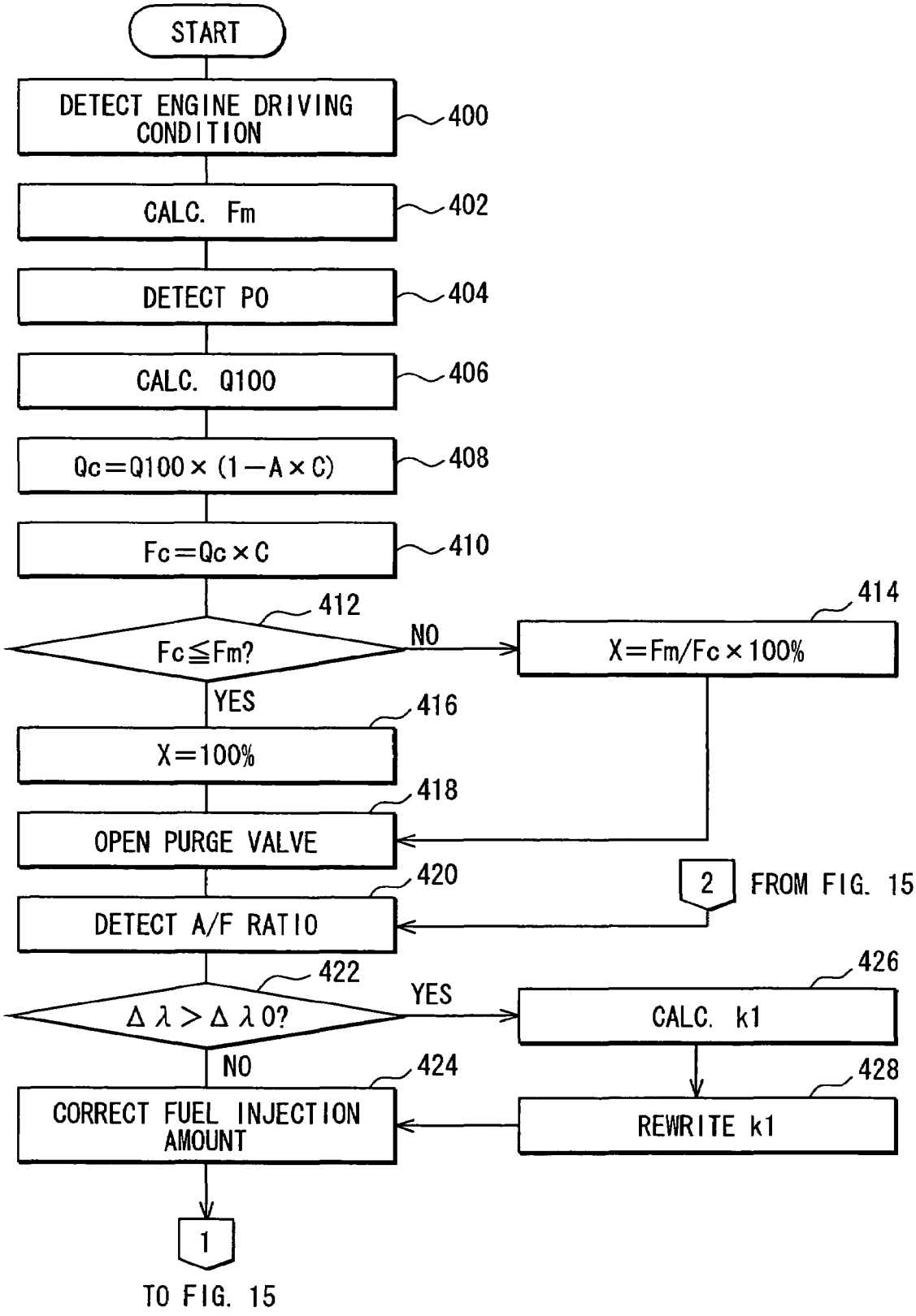

FIGS. 14 and 15 show a purge routine in the second embodiment. The processes in steps 400-420 are the same process as in steps 350-370 in FIG. 12. In step 422, the CPU 52 determines whether Δλ(=|λ1−λ0|) is larger than a predetermined value Δλ0. If the fuel vapor amount which is purged from the canister and the fuel injection amount are correctly controlled, it must be that Δλ≦Δλ0.

When the answer is No in step 422, the CPU 52 determines that the fuel vapor amount that is purged and the fuel injection amount are correctly controlled. The procedure proceeds to step 424 in which the fuel injection amount is corrected based the value of Δλ.

When the answer is Yes in step 422, the CPU 52 determines that the fuel vapor amount which is purged is not correct and the value of Fc is not correct. The value of Fc is calculated according to the equations (8) and (9). In a case that the reference quantity Q100 does not change relative to a change in the intake pressure P0, or in a case that the reference quantity has just corrected, the CPU 52 determines that the fuel vapor concentration C is not correct.

The fuel vapor concentration C is calculated based on the coefficient k1, $\Delta P_{GAS}$, and $\Delta P_{AIR}$ as shown in the equation (2). According to the second embodiment, the CPU 52 determines that the fuel vapor concentration is not correct because the coefficient k1 is incorrect. In step 426, a following equation (15) is derived from the equation (14). The actual fuel vapor concentration C is obtained according to the equation (15), and the correct coefficient k1 is obtained according to the equation (2).

$$A(\lambda\times\rho_{HC}+\rho_{AIR})C^2-(A\times\rho_{AIR}+\lambda\times\rho_{HC}+\rho_{AIR})C+\rho_{AIR}+(Ai-\lambda\times Fi)/(Q100\times X)=0 \quad (15)$$

In step 428, the CPU 52 rewrite k1 stored in the ROM 56 into k1 that is calculated in step 426.

In step 430, the CPU 52 determines whether the purge stop condition is established. When the answer is Yes, the procedure proceeds to step 432 in which the purge valve 36 is closed and the purge routine ends. When the answer is No, the procedure goes back to step 420.

As described above, according to the second embodiment, when the difference between the actual air-fuel ratio and the target air-fuel ratio exceeds a predetermined value, the coefficient k1 in the equation (2) is corrected in order to calculate the fuel vapor concentration C. Thereby, the actual air-fuel ratio becomes close to the target air-fuel ratio so that the difference therebetween becomes small.

Third Embodiment

A structure of the fuel vapor treatment apparatus 30, the main routine (refer to FIG. 10), and the concentration measuring routine (refer to FIG. 11) are substantially the same as the first embodiment.

Figure 16:
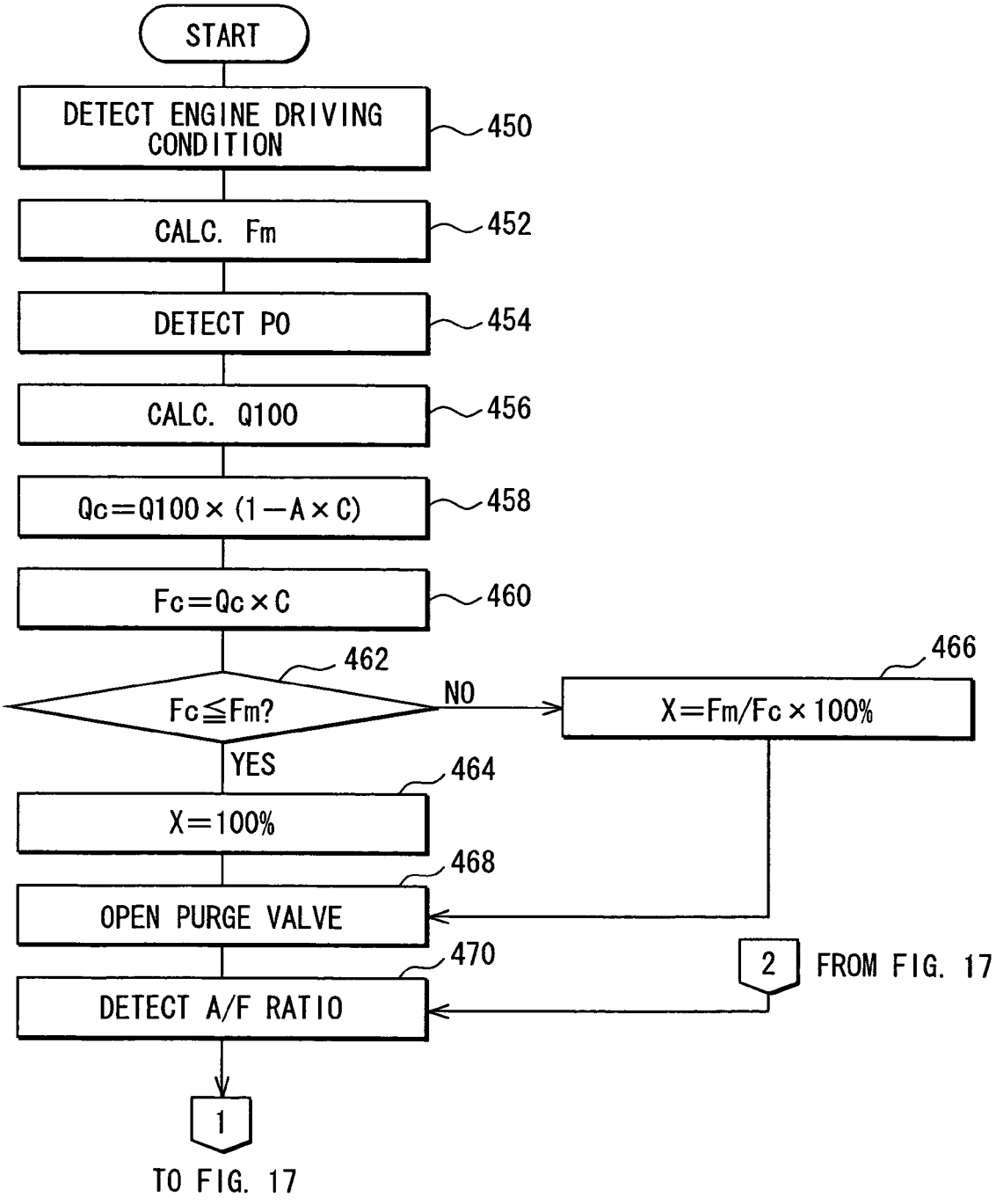
FIG. 16 and FIG. 17 are flowcharts showing a purge routine according to a third embodiment.
Figure 17:
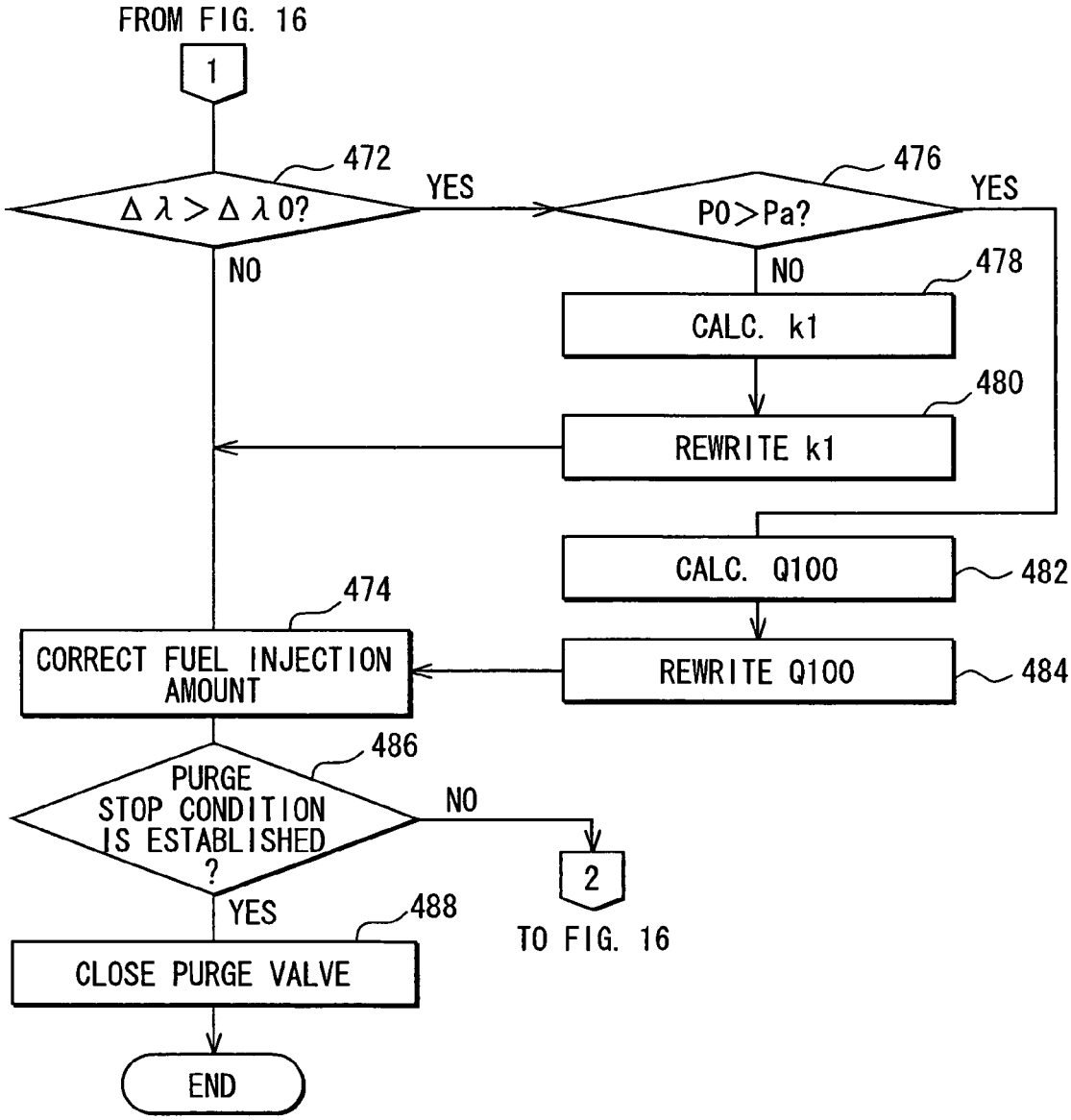

FIGS. 16 and 17 show a purge routine in the second embodiment. The processes in steps 450-470 are the same process as in steps 350-370 in FIG. 12.

In step 472, the CPU 52 determines whether $\Delta\lambda(=|\lambda 1-\lambda 0|)$ is larger than a predetermined value $\Delta\lambda 0$. If the fuel vapor amount which is purged from the canister and the fuel injection amount are correctly controlled, it must be that $\Delta\lambda \leqq \Delta\lambda 0$.

When the answer is No in step 422, the CPU 52 determines that the fuel vapor amount that is purged and the fuel injection amount are correctly controlled. The procedure proceeds to step 474 in which the fuel injection amount is corrected based the value of $\Delta\lambda$.

Figure 7:
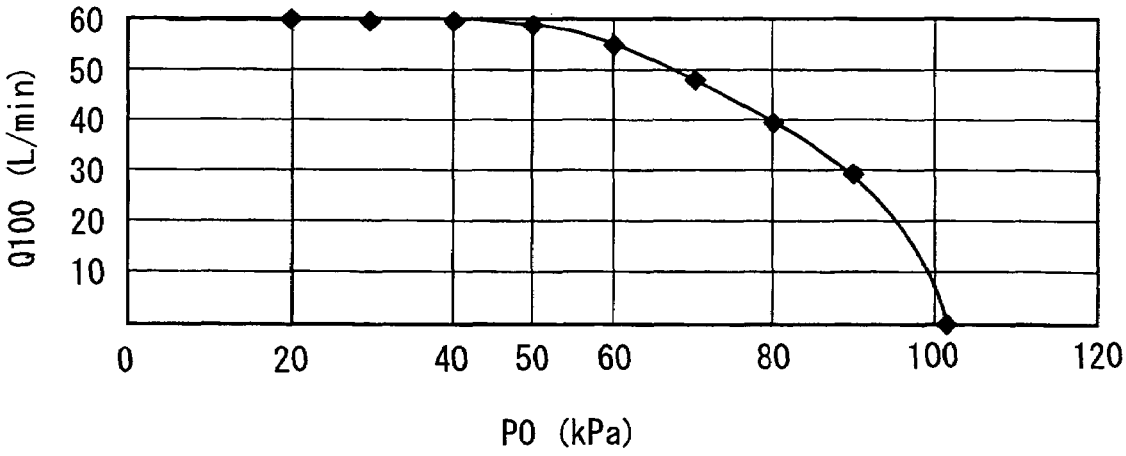
FIG. 7 is a characteristic chart showing a relationship between the intake pressure and the reference quantity.

When the answer is Yes in step 422, the CPU 52 determines that the fuel vapor amount which is purged is not correct and the value of Fc is not correct. The value of Fc is calculated according to the equations (8) and (9). Thus, it can be determined the value of Fc is incorrect because the reference quantity Q100 or the fuel vapor concentration C is not correct. As shown in FIG. 7, the variation in reference quantity Q100 is relatively small in a range where P0≦Pa, and the variation is relatively large in a range where P0>Pa. In FIG. 7, Pa is 50 kPa. It is understand that in the rage where P0≦Pa, the value of Fc is incorrect due to incorrectness of the fuel vapor concentration C, and in the rage where P0>Pa, the value of Fc is incorrect due to incorrectness of the reference quantity Q100.

In step 476, the CPU 52 determines whether P0 22 Pa. When the answer is Yes, the procedure proceeds to step 482 in which the reference quantity Q100 is calculated. Then, in step 484, the reference quantity Q100 in map shown in FIG. 8 is rewritten. When the answer is No in step 476, the procedure proceeds to step 478 and step 480. In these steps, the coefficient k1 is calculated in order to calculate the fuel vapor concentration C and the coefficient k1 stored in the ROM 56 is rewritten.

After the reference quantity Q100 and the coefficient k1 are rewritten, the CPU 52 corrects the fuel injection amount based on the value of $\Delta\lambda$ in step 474.

In step 486, the CPU 52 determines whether the purge stop condition is established. When the purge stop condition is established, the procedure proceeds to step 488 in which the purge valve 36 is closed to end the routine. When the purge stop condition is not established, the procedure proceeds to step 470.

As described above, according to the third embodiment, in a range where a variation ratio of the reference quantity Q100 is relatively small, the concentration characteristic is corrected. In a range where the variation ratio is relatively large, the flow characteristic of the purge valve 36 is corrected. That is, in a condition where the variation in air-fuel ratio is small by correcting the flow characteristic, the concentration characteristic is corrected, and in a condition where the variation in air-fuel ratio is large, the flow characteristic is corrected. Thereby, the actual air-fuel ratio becomes close to the target air-fuel ratio effectively.

MODIFICATION

In the above embodiments, the flow characteristic of the purge valve 36, which is shown in FIG. 7, is stored as the map shown in FIG. 8.

In a modification, the flow characteristic of the purge valve 36 can be approximated by a function. The reference quantity Q may be obtained from the approximate function.

The differential pressure ratio Pp ($\Delta P_{GAS}/\Delta P_{AIR}$) and the fuel vapor concentration characteristic may be store in a map. The fuel vapor concentration may be obtained from the map.

What is claimed is:

1. A fuel vapor treatment apparatus comprising:

a canister adsorbing fuel vapor evaporated in a fuel tank, the fuel vapor being to be purged into an intake passage of an internal combustion engine;

a purge valve provided in a purge passage through which the fuel vapor is introduced into the intake passage from the canister, the purge valve controlling an amount of the fuel vapor which is purged into the intake passage;

a measuring means for measuring a condition of the fuel vapor which is purged into the intake passage;

a memory storing a fluid characteristic of the purge valve;

an air-fuel ratio controlling means for controlling an opening degree of the purge valve and/or a fuel injection amount based on the fluid characteristic and a measure-result measured by the measuring means so that an air fuel ratio of the internal combustion engine becomes close to a target air-fuel ratio; and a correction means for correcting the fluid characteristic stored in the memory means in a case that a difference between an actual air-fuel ratio and the target air-fuel ratio exceeds a predetermined value.

2. The fuel vapor treatment apparatus according to claim 1, wherein the memory stores a characteristic map, as the flow characteristic, showing a relationship between an intake pressure in the intake passage and a flow amount passing through the purge valve, and the correction means corrects the characteristic map stored in the memory in a case that the difference between an actual air-fuel ratio and the target air-fuel ratio exceeds a predetermined value.

3. The fuel vapor treatment apparatus according to claim 2, wherein the correction means calculates the flow amount passing through the purge valve based on the actual air-fuel ratio, an intake air amount introduced into the intake passage, a fuel injection amount, and the measure-result measured by the measuring means, and corrects the flow amount relative to the intake pressure in the characteristic map based on the calculated flow amount.

4. The fuel vapor treatment apparatus according to claim 1, wherein the measuring means includes:

a measuring passage provided with an orifice therein;

a switching means connected to a first end of the measuring passage, and switching between a first position where the orifice communicates with atmosphere and a second position where the orifice communicates with the canister;

a gas flow generating means connected to a second end of the measuring passage opposite to the switching means with respect to the orifice, and generating a gas flow in the measuring passage; and a pressure detecting means provided between the orifice and the gas flow generating means in order to detect pressure that depends on the orifice and the gas flow generating means, and the measuring means measures a condition of the fuel vapor in mixture of air and the fuel vapor based on a first pressure and a second pressure with the gas flow generating means operated, the first pressure being detected by the pressure detecting means in a case that the orifice communicates with the atmosphere, the second pressure is detected by the pressure detecting means in a case that the orifice communicates with the canister while no fuel vapor is purged into the intake passage from the canister.

5. The fuel vapor treatment apparatus according to claim 1, wherein the condition of the fuel vapor represents concentration of the fuel vapor.

6. The fuel vapor treatment apparatus according to claim 4, wherein the gas flow generating means is an electric pump.

7. The fuel vapor treatment apparatus according to claim 4, wherein the pressure detecting means is an absolute pressure sensor.

8. The fuel vapor treatment apparatus according to claim 4, wherein the pressure that depends on the orifice and the gas flow generating means is a differential pressure between both ends of the orifice.

9. The fuel vapor treatment apparatus according to claim 8, wherein the pressure detecting means is a differential pressure detector which detects the differential pressure between both ends of the orifice.

10. A fuel vapor treatment apparatus comprising:

a canister adsorbing fuel vapor evaporated in a fuel tank, the fuel vapor being to be purged into an intake passage of an internal combustion engine;

a purge valve provided in a purge passage through which the fuel vapor is introduced into the intake passage from the canister, the purge valve controlling an amount of the fuel vapor which is purged into the intake passage;

a measuring passage provided with an orifice therein;

a switching means connected to a first end of the measuring passage, and switching between a first position where the orifice communicates with atmosphere and a second position where the orifice communicates with the canister;

a gas flow generating means connected to a second end of the measuring passage opposite to the switching means with respect to the orifice, and generating a gas flow in the measuring passage;

a pressure detecting means for detecting pressure that depends on the orifice and the gas flow generating means;

a memory storing a characteristic of fuel vapor condition which specifies the fuel vapor condition of mixture of air and the fuel vapor based on a ratio between a first pressure and a second pressure, the first pressure being a pressure depending on the orifice and the gas flow generating means in a case that only air flows through the orifice, the second pressure being a pressure depending on the orifice and the gas flow generating means in a case the mixture flows through the orifice;

an obtaining means for obtaining the condition of the fuel vapor from the characteristic of the fuel vapor condition, the condition of the fuel vapor corresponding to a ratio between the first pressure and the second pressure, the first pressure being detected by the pressure detecting means in a case that the orifice communicates with the atmosphere, the second pressure being pressure of the mixture detected by the pressure detecting means in a case that the orifice communicates with the canister while the no fuel vapor is purged from the canister to the intake passage;

an air-fuel ratio controlling means for controlling an opening degree of the purge valve based on the flow characteristic and the condition of the fuel vapor obtained by the obtaining means so that an air fuel ratio of the internal combustion engine becomes close to a target air-fuel ratio; and a correction means for correcting the fluid characteristic stored in the memory means in a case that a difference between an actual air-fuel ratio and the target air-fuel ratio exceeds a predetermined value.

11. The fuel vapor treatment apparatus according to claim 10, wherein the memory stores a function which specifies the condition of the fuel vapor according to a ratio between the first pressure and the second pressure, and the correction means corrects a coefficient of the function in a case that the difference between the actual air-fuel ratio and the target air-fuel ratio exceeds the predetermined value.

12. The fuel vapor treatment apparatus according to claim 10, wherein the condition of the fuel vapor represents concentration of the fuel vapor.

13. The fuel vapor treatment apparatus according to claim 10, wherein the gas flow generating means is an electric pump.

14. The fuel vapor treatment apparatus according to claim 10, wherein the pressure detecting means is an absolute pressure sensor.

15. The fuel vapor treatment apparatus according to claim 10, wherein the pressure that depends on the orifice and the gas flow generating means is a differential pressure between both ends of the orifice.

16. The fuel vapor treatment apparatus according to claim 15, wherein the pressure detecting means is a differential pressure detector which detects the differential pressure between both ends of the orifice.

17. A fuel vapor treatment apparatus comprising:

a canister adsorbing fuel vapor evaporated in a fuel tank, the fuel vapor being to be purged into an intake passage of an internal combustion engine;

a purge valve provided in a purge passage through which the fuel vapor is introduced into the intake passage from the canister, the purge valve controlling an amount of the fuel vapor which is purged into the intake passage;

a first memory storing a flow characteristic of the purge valve;

a measuring passage provided with an orifice therein;

a switching means connected to a first end of the measuring passage, and switching between a first position where the orifice communicates with atmosphere and a second position where the orifice communicates with the canister;

a gas flow generating means connected to a second end of the measuring passage opposite to the switching means with respect to the orifice, and generating a gas flow in the measuring passage;

a pressure detecting means for detecting pressure that depends on the orifice and the gas flow generating means;

a second memory storing a characteristic of fuel vapor condition which specifies the fuel vapor condition of mixture of air and the fuel vapor based on a ratio between a first pressure and a second pressure, the first pressure being a pressure depending on the orifice and the gas flow generating means in a case that only air flows through the orifice, the second pressure being a pressure depending on the orifice and the gas flow generating means in a case the mixture flows through the orifice;

an obtaining means for obtaining the condition of the fuel vapor from the characteristic of the fuel vapor condition, the condition of the fuel vapor corresponding to a ratio between the first pressure and the second pressure, the first pressure being detected by the pressure detecting means in a case that the orifice communicates with the atmosphere, the second pressure being pressure of the mixture detected by the pressure detecting means in a case that the orifice communicates with the canister while the no fuel vapor is purged from the canister to the intake passage;

an air-fuel ratio controlling means for controlling an opening degree of the purge valve and/or a fuel injection amount based on the flow characteristic and the condition of the fuel vapor obtained by the obtaining means so that an air fuel ratio of the internal combustion engine becomes close to a target air-fuel ratio; and a correction means for correcting the fluid characteristic stored in the first memory means in a range where the flow amount flowing through the purge valve increases according to the intake pressure and for correcting the characteristic of fuel vapor condition stored in the second memory, in a case that a difference between an actual air-fuel ratio and the target air-fuel ratio exceeds a predetermined value.

18. The fuel vapor treatment apparatus according to claim 17, wherein the condition of the fuel vapor represents concentration of the fuel vapor.

19. The fuel vapor treatment apparatus according to claim 17, wherein the gas flow generating means is an electric pump.

20. The fuel vapor treatment apparatus according to claim 17, wherein the pressure detecting means is an absolute pressure sensor.

21. The fuel vapor treatment apparatus according to claim 17, wherein the pressure that depends on the orifice and the gas flow generating means is a differential pressure between both ends of the orifice.

22. The fuel vapor treatment apparatus according to claim 21, wherein the pressure detecting means is a differential pressure detector which detects the differential pressure between both ends of the orifice.

* * * * *